US009382673B2

(12) United States Patent
Meier

(10) Patent No.: US 9,382,673 B2
(45) Date of Patent: Jul. 5, 2016

(54) QUICK-CHANGE TOOL HOLDER FOR A COMPACTION DRUM FOR A SOIL COMPACTOR

(71) Applicant: HAMM AG, Tirschenreuth (DE)

(72) Inventor: Matthias Meier, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 0 days.

(21) Appl. No.: 14/470,650

(22) Filed: Aug. 27, 2014

(65) Prior Publication Data

US 2015/0063909 A1 Mar. 5, 2015

(30) Foreign Application Priority Data

Aug. 27, 2013 (DE) ..... 10 2013 217 042

(51) Int. Cl.
*E01C 19/23* (2006.01)
*E02D 3/039* (2006.01)

(52) U.S. Cl.
CPC ..... *E01C 19/236* (2013.01); *E02D 3/039* (2013.01)

(58) Field of Classification Search
CPC ..... E01C 19/236; E02D 3/039
USPC ..... 404/121, 124
See application file for complete search history.

(56) References Cited

U.S. PATENT DOCUMENTS 840,788 A * 1/1907 Meade ..... A01B 33/021 172/547
1,536,178 A * 5/1925 Hackett ..... B23D 61/06 299/108
2,131,947 A * 10/1938 Gilmore ..... E02D 3/026 172/554
2,242,808 A * 5/1941 Austin ..... E02D 3/026 172/554
2,507,968 A 5/1950 Frenzel
2,893,298 A * 7/1959 Averette ..... B21D 37/04 292/355
3,099,191 A * 7/1963 Averette ..... E02D 3/026 172/556
3,126,654 A * 3/1964 Eyolfson et al. ..... E02F 9/2841 172/713
3,252,391 A * 5/1966 Dils, Jr. ..... E02D 3/026 301/44.1
3,274,908 A * 9/1966 Grant ..... E02D 3/026 404/121
3,817,645 A 6/1974 Trainor et al.
3,822,957 A * 7/1974 Caron ..... E02D 3/026 172/554

(Continued)

FOREIGN PATENT DOCUMENTS

CN 1309740 A 8/2001
CN 101607429 A 12/2009

(Continued)

OTHER PUBLICATIONS

German Search Report issued for German Patent Application No. 10 2013 217 042.4 dated Mar. 19, 2014, 4 pages.

(Continued)

*Primary Examiner* — Raymond W Addie
(74) *Attorney, Agent, or Firm* — Rothwell, Figg, Ernst & Manbeck, P.C.

(57) ABSTRACT

A quick-change tool holder for the attachment of a drum tool to a compaction drum of a soil compactor includes a quick-change tool holder body having a central region, a holder opening for receiving a holder shaft of a drum tool in the central region, and two leg portions originating at the central region for firmly connecting the quick-change tool holder body to the outer periphery of a compaction drum. The central region and the leg portions surrounding an open inner space of the quick-change tool holder extend over at least one side opening. In association with at least one side opening, a closing element can be inserted therein.

13 Claims, 4 Drawing Sheets

(56) References Cited

U.S. PATENT DOCUMENTS

| | | | | | |
|---|---|---|---|---|---|
| 4,066,375 | A * | 1/1978 | Caron | E02D 3/026 172/554 |
| 4,668,122 | A * | 5/1987 | Riddle | E02D 3/026 172/122 |
| 5,795,097 | A * | 8/1998 | Caron | B09B 1/00 301/44.1 |
| 2012/0213586 | A1 * | 8/2012 | Ugru | E02D 3/039 404/121 |

FOREIGN PATENT DOCUMENTS

| | | | | |
|---|---|---|---|---|
| CN | 204266096 U | | 4/2015 | |
| GB | 2029761 | * | 8/1978 | B28D 1/22 |
| JP | H11-209964 A | | 8/1999 | |
| WO | 2013 107545 A2 | | 7/2013 | |

OTHER PUBLICATIONS

Search Report issued for European Patent Application No. 14162123.1 dated Nov. 21, 2014, with machine translation, 10 pages.

* cited by examiner

QUICK-CHANGE TOOL HOLDER FOR A COMPACTION DRUM FOR A SOIL COMPACTOR

RELATED APPLICATION DATA

This application claims the benefit of priority pursuant to 35 U.S.C. §119 from German Patent Application No. 10 2013 217 042.4, filed Aug. 27, 2013, the entire contents of which are incorporated herein by reference.

BACKGROUND OF THE INVENTION

1. Field of the Invention

The present invention relates to a quick-change tool holder for the attachment of a drum tool to a compaction drum comprising a quick-change tool holder body having a central region, wherein a holder opening for receiving a holder shaft of a drum tool is provided in the central region, and two leg portions originating at the central region for firmly connecting the body of the quick-change tool holder to the outer periphery of the compaction drum, the central region and the leg portions surrounding an open inner space of the quick-change tool holder extending over at least one side opening.

2. Description of the Related Art

A quick-change tool holder of this type is known from WO 2013/107545 A2. A large number of quick-change tool holders having a trapezoidal shape when viewed in the axial direction—with respect to the axis of rotation of the compaction drum—are attached to the outer periphery of a compaction drum or a drum sleeve thereof. The quick-change tool holder bodies of the quick-change tool holders are elongated in the peripheral direction and have two peripheral sides oriented in the peripheral direction and two axial sides oriented in the direction of the axis of rotation of the compaction drum. The two peripheral sides and also the axial sides are tilted relative to one another in such a way that the quick-change tool holder tapers from a connection region connected to the compaction drum toward the bearing side of the drum tool provided to support a drum tool.

A holder opening is provided in the central region of this quick-change tool holder body, into which a holder shaft provided in the drum tool can be inserted. In order to lock the drum tool to the body of the quick-change tool holder, a circular locking means surrounding the holder shaft is provided, which can be positioned engaging in a groove-like receiving opening of the locking means at the quick-change tool holder body on one side, and a groove-like receiving opening on the holder shaft on the other side.

The central region of the body of the quick-change tool holder surrounds an inner space of the quick-change tool holder, which is open on both axial sides of the body of the quick-change tool holder via respective side openings, with two leg portions provided to connect said body of the quick-change tool holder to a compaction drum. With the drum tool supported on the body of the quick-change tool holder, the holder shaft provided on the drum tool protrudes into the inner space of the quick-change tool holder. In order to detach a drum tool locked onto the body of the quick-change tool holder a tool, by way of example a crowbar or the like, can be inserted into the inner space of the quick-change tool holder through one of the side openings, and the holder shaft pushed out into the groove-like receiving opening of the locking means on the body of the quick-change tool holder by releasing the locking engagement.

When a soil compactor configured with a compaction drum of this type is in operation, boulders, soil or the like get into the inner space of the quick-change tool holder through the side openings. If a drum tool is to be detached from the quick-change tool holder, it is therefore generally necessary that the material which has penetrated into the inner space of the quick-change tool holder be removed to start with, which is a very time-consuming working process, in particular when this material becomes wedged, or has dried in the inner space of the quick-change tool holder.

SUMMARY OF THE INVENTION

It is the object of the present invention to provide a quick-change tool holder for a compaction drum for a soil compactor, in which the process of detaching a drum tool is essentially not affected by soiling.

According to the present invention, this object is attained by a quick-change tool holder for the attachment of a drum tool to a compaction drum comprising a body of the quick-change tool holder with a central region, wherein a holder opening for receiving a holder shaft of a drum tool is provided in the central region, and two leg portions originating at the central region for firmly connecting the body of the quick-change tool holder to the outer periphery of the compaction drum, the central region and the leg portions surrounding an open inner space of the quick-change tool holder extending over at least one side opening.

It is furthermore provided that in association with at least one side opening, a closing element, which can be inserted therein, is provided.

By providing a closing element that can be inserted into a side opening, the body of the quick-change tool holder can also be closed against the penetration of debris into those regions where the inner space of the quick-change tool holder is basically open over one or more side openings. If, in order to detach a drum tool from the body of the quick-change tool holder, it is necessary to penetrate into the inner space of the quick-change tool holder, an access through at least one side opening must previously be created so that a locking means inserted therein can be removed. Complex procedures to remove debris that has penetrated into the inner space of the quick-change tool holder are therefore not necessary.

In order to prevent, as far as possible, debris from penetrating into the quick-change tool holder, according to the present invention, it is proposed that an inner peripheral contour of a side opening corresponds to an outer peripheral contour of a closing element.

According to the present invention, the quick-change tool holder can be configured in such a way that the body of the quick-change tool holder has two axial sides mutually opposing one another and essentially oriented in the direction of an axis of rotation of a compaction drum, and two peripheral sides mutually opposing one another and essentially oriented in the peripheral direction around the axis of rotation of a compaction drum, and that at least one side opening is provided in an axial side of the body of the quick-change tool holder. Because a closing element inserted into a side opening that is oriented or positioned in this way is essentially oriented in the direction of an axis of rotation of a compaction drum, said closing element is under comparatively light stress, so that the risk of damage thereto is significantly lower than it is with a configuration in which a closing element of this type was oriented in the peripheral direction.

In order to prevent an undesired detachment of a closing element from the body of the quick-change tool holder, it is proposed that the closing element can be locked with respect to the body of the quick-change tool holder.

With an embodiment that is advantageous due to the simplicity of manufacture and the flexible access to a drum tool, it is proposed that two mutually essentially opposing side openings be provided, and that, in association with each side opening, one closing element be provided.

With such a configuration, two closing elements can be easily secured in that two closing elements inserted into two side openings essentially opposing one another can be locked by securing them to one another relative to the body of the quick-change tool holder, wherein the closing elements can preferentially be secured to one another by means of screws.

In order to ensure that a closing element to be inserted into a side opening cannot penetrate too deeply therein, it is proposed that at least one closing element has an insertion limitation means to limit an insertion depth of the closing element into the associated side opening.

According to another especially advantageous aspect, it can be provided that on at least one closing element a locking region for a locking interaction with a counter-locking region is provided on the drum tool to be locked onto the body of the quick-change tool holder. The closing element thus not only performs the function of keeping debris out of the inner space of the quick-change tool holder, it can also meet the functional requirements for locking a drum tool.

To this end, it can, by way of example, be provided that the locking region comprises a locking engagement region to engage in a locking recess of the counter-locking region provided at the holder shaft of a drum tool. The locking engagement can be created simply in that the drum tool is first inserted with its holder shaft into the holder opening, namely in such a way that the holder shaft is situated with the locking recess of the counter-locking region in the inner space of the quick-change tool holder. Subsequently, a closing element can be inserted into a side opening until it engages in the locking recess with the locking engagement region provided thereon. A form-fitting locking is then generated that prevents the holder shaft from being pulled out of the holder opening.

In order to ensure a stable locking interaction between the locking engagement region and the locking recess, it is proposed that the locking engagement region be provided on a closing element preferentially configured as a plate-like locking element.

An especially stable locking interaction can be achieved in that the locking engagement regions of two closing elements can be positioned engaging in the locking recess of the counter-locking region at least sectionally encompassing the holder shaft of a drum tool.

In a further development of the quick-change tool holder, according to the present invention, which is particularly advantageous for cost reasons, it is proposed that at least one closing element be made of plastic or/and rubber.

The present invention further relates to a quick-change tool holder arrangement for a compaction drum for a soil compactor, which comprises a quick-change tool holder configured according to the present invention, as well as at least one drum tool that can be locked thereon.

Furthermore, the invention relates to a compaction drum for a soil compactor having at least one quick-change tool holder configured according to the present invention secured to the outer periphery of the compaction drum and preferably also a drum tool that can be locked thereon.

The invention also relates to a soil compactor with at least one compaction drum of this type.

BRIEF DESCRIPTION OF THE DRAWINGS

The present invention will hereinafter be described in detail with reference to the attached figures. They show.

DETAILED DESCRIPTION OF THE PREFERRED EMBODIMENTS

Figure 1:
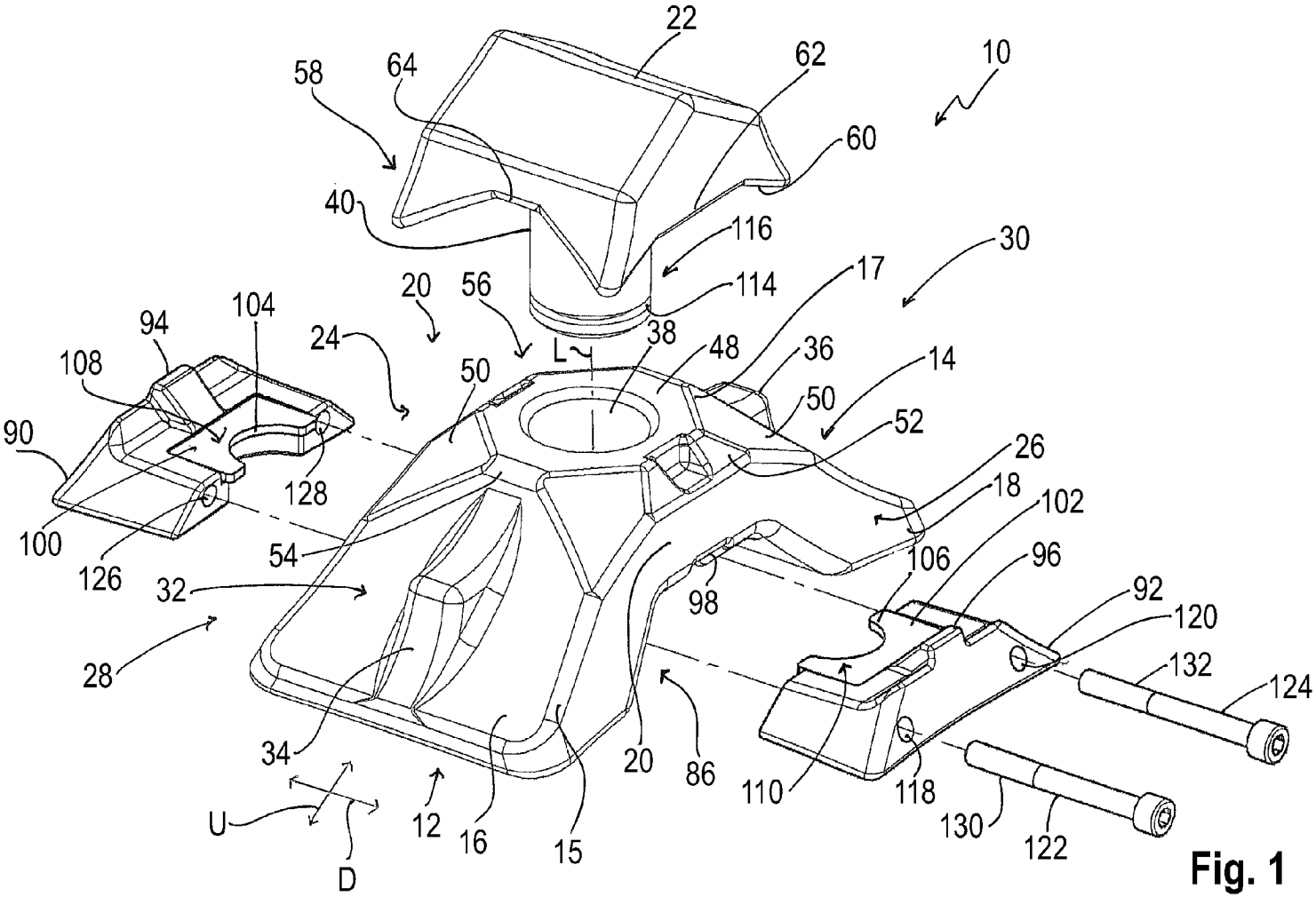
FIG. 1 an expanded view of a quick-change tool holder arrangement with a quick-change tool holder and a drum tool that can be locked thereon.
Figure 2:
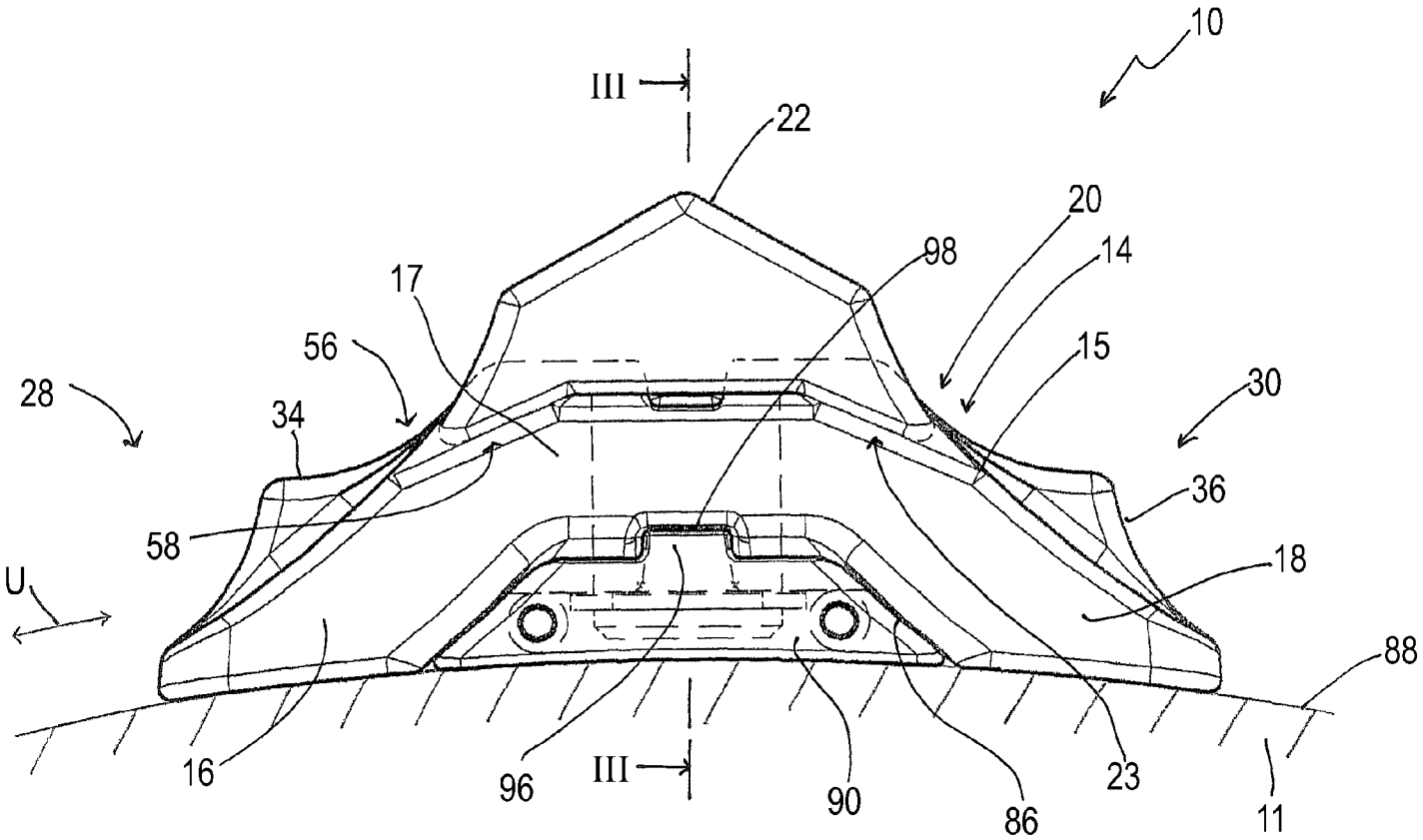
FIG. 2 a lateral view of the quick-change tool holder arrangement of FIG. 1 on the outer periphery of a drum sleeve of a compaction drum.
Figure 3:
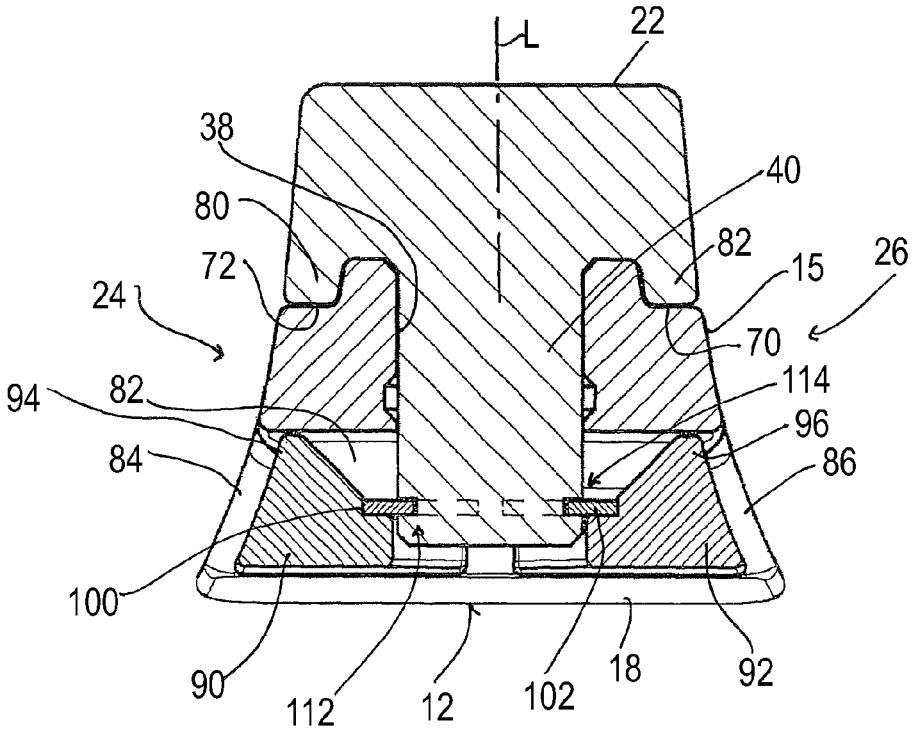
FIG. 3 a sectional view of the quick-change tool holder arrangement in FIG. 2, cut along a line in FIG. 2.
Figure 4:
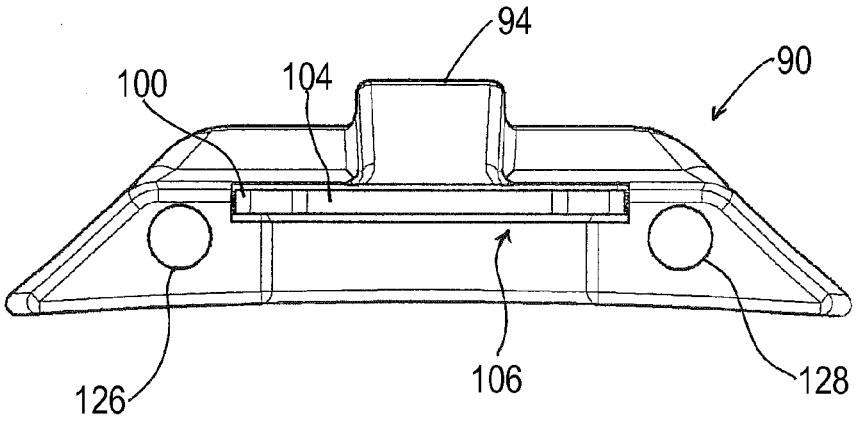
FIG. 4 a lateral view of a closing element to be inserted into a side opening of the quick-change tool holder in FIG. 1 in the direction of view IV in FIG. 5.
Figure 5:
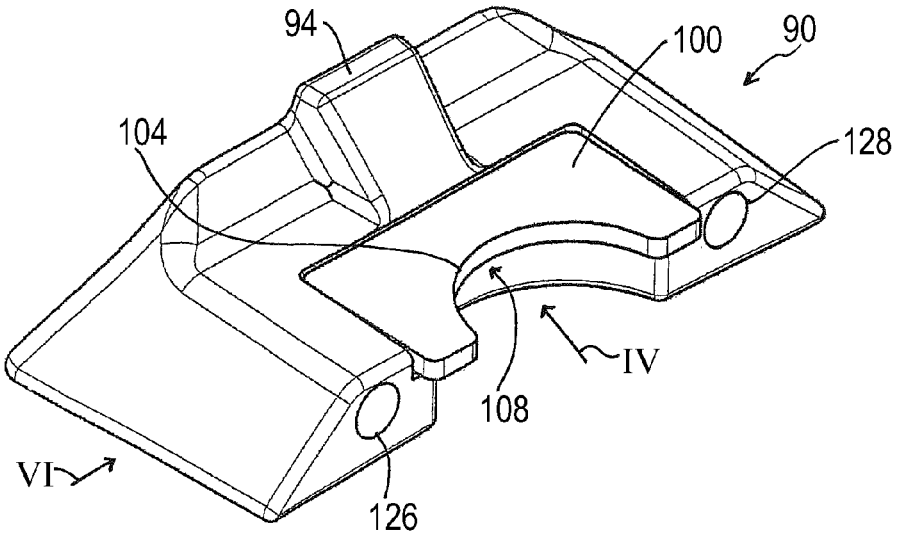
FIG. 5 a perspective view of the closing element of FIG. 4.
Figure 6:
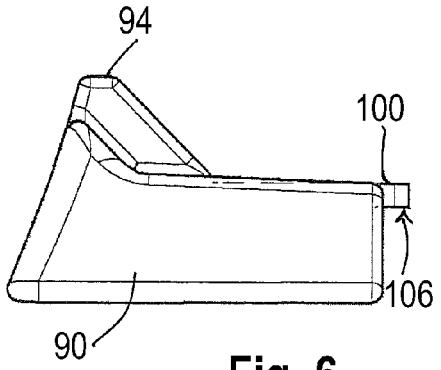
FIG. 6 the closing element of FIG. 4 in the direction of view in FIG. 5.
Figure 7:
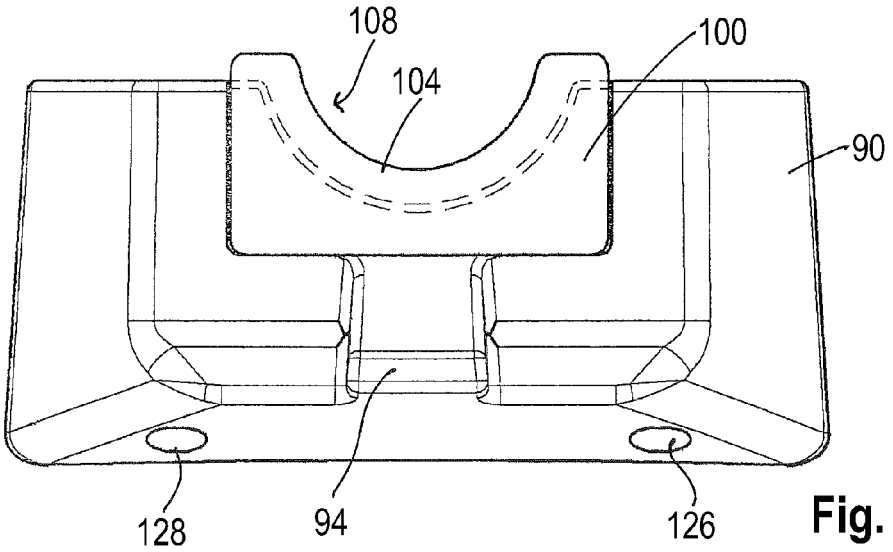
FIG. 7 a top view of the closing element of FIG. 4.

The quick-change tool holder arrangement 10 shown in FIGS. 1 to 3 comprises a quick-change tool holder to be secured to a connection region, in general designated with 12, on the outer periphery of a drum sleeve 11 of a compaction drum of a soil compactor. This quick-change tool holder 14 having a trapezoidal shape in the lateral view in FIG. 1 is configured with an in general U-shaped quick-change tool holder body 15 having a central region 17 and two leg portions 16, 18 originating therefrom, and is to be secured to the leg portions 16, 18 to the roller sleeve by welding. On a bearing side 20 of the drum tool to be positioned at a distance from the drum sleeve 11, the quick-change tool holder 14 is configured with its quick-change tool holder body 15 in such a way that it can receive, or support with its bearing side 23 of the quick-change tool holder, a drum tool 22, which is configured as a padfoot in the exemplary embodiment of FIGS. 1 and 2.

When the quick-change tool holder body 15, also shown as a perspective view in FIG. 1, is attached to the outer periphery of a drum sleeve, said quick-change tool holder body 15 comprises two axial sides 24, 26 preferentially oriented in the direction D of an axis of rotation of a compaction drum, and two peripheral sides 28, 30 preferentially oriented in the peripheral direction U around this axis of rotation D of the compaction drum. The axial sides 24, 26, as well as the peripheral sides 28, 30 are angled with respect to one another, the tilt angle of the peripheral sides 28, 30 being larger relative to one another than the tilt angle of the axial sides 24, 26. The quick-change tool holder body 15 can be elongated in the peripheral direction, namely in the direction of the peripheral sides 28, 30.

A blade-like, protruding soil-working projection 34, 36 is respectively provided on the two leg portions 16, 18 in a soil-working region 32 not covered by the drum tool 22. During the compaction or crushing operation, these soil-working projections 34, 36 come into contact with the substrate to be processed and can crush stones or boulders.

A holder opening 38 extending in the direction of a longitudinal axis L of an opening is configured in a central region 17 of the quick-change tool holder body 15. A holder shaft 40 that can be inserted into this holder opening 38 is provided on the drum tool 22. The holder opening 38 as well as the holder shaft 40 are configured, by way of example, with a circular cross-section.

On the bearing side 20 of the drum tool that can be seen in FIG. 1, a first supporting surface 48, which is, by way of example, essentially orthogonally oriented relative to the longitudinal axis L of the holder opening 38 is provided surrounding the holder opening 38 in the quick-change tool holder body 15. In the regions between each peripheral side 28, 30 adjacent to the axial sides 24, 26, second supporting surfaces 50 are provided relative to the longitudinal axis L of the opening that are radially adjacent on the outside to the first supporting surface 48. A third supporting surface 52 is respectively provided between two second surfaces 50 in association with the same axial side 24 or 26. Correspondingly, fourth supporting surfaces 54 are respectively provided between two second supporting surfaces 50 respectively associated with the same peripheral side 28 or 30.

The second supporting surfaces 50, third supporting surfaces 52, and fourth supporting surfaces 54 form a facet-like or prism-like surface circularly surrounding the first supporting surface 48, which in general provides a form-fitting engagement 56. For a supporting interaction therewith, the drum tool 22 has a counter form-fitting engagement means in general designated with 58 on its bearing side 23 of the quick-change tool holder. In the four corners of the drum tool 22, said counter form-fitting engagement means 58 comprises respective second counter supporting regions 60 which can come into contact with the second supporting surface 50. Between two second counter-supporting regions 60 there is a respective third counter-supporting region 62, which can supportingly interact with a respective third supporting surface 52. Correspondingly, between two second counter-supporting regions 60 adjacent to one another, there respectively are fourth counter-supporting regions 64, which can supportingly interact with a respective fourth supporting surface 54. Owing to the complementary shape of the form-fitting engagement means 56 with the counter-form-fitting engagement means 58, a uniform load distribution from the drum tool 22 to the quick-change tool holder body 15 is achieved during the compaction or crushing operation. At the same time, a certain level of anti-rotation protection for the drum tool 22 is provided, because a rotation thereof relative to the quick-change tool holder 14 would only be possible, if the snap-in engagement of the locking means 42 in the receiving opening 46 of the quick-change tool holder 14 were cancelled, and the holder shaft 40 were at least partially pulled out of the holder opening 38.

Independently of the previously described interaction of the form-fitting engagement means 56 with the counter-form-fitting engagement means 58 or additionally thereto, anti-rotation recesses 70, 72 are provided on the quick-change tool holder body 15 in the side regions relative to the holder opening 14 in order to ensure a further increased rotational stability. They radially connect to the first supporting surface 48 on the outside or can extend into the region thereof and essentially diametrically oppose one another relative to the holder opening 38 or to the longitudinal axis L of the opening. It can be seen that the two anti-rotation recesses 70, 72 are essentially configured in the region of the third supporting surfaces 52, and that they are open in the direction of the longitudinal axis L of the opening away from the direction of the connection region 12, as well as in the direction of the axial sides 24, 26. In association with these two anti-rotation recesses 70, 72, anti-rotation projections 78, 80 are provided on the drum tool 22 in the side regions relative to the holder shaft 40. They essentially oppose one another diametrically relative to the holder shaft 40 and are dimensioned and positioned in such a way that they engage in the anti-rotation recesses 70, 72 in the drum tool 22 attached to the quick-change tool holder 14. In this way, a stable rotational fixation is created for the drum tool 22 relative to the quick-change tool holder body 15.

With its central region 17 and the two leg portions 16, 18, the quick-change tool holder body 15 encloses an inner space 82 of the quick-change tool holder, which is open on both axial sides 24, 26 via respective side openings 84, 86. In the direction of the compaction drum, the inner space 82 of the quick-change tool holder is limited by the outer surface 88 of the drum sleeve 11. When the holder shaft 40 is inserted in the holder opening 38, it protrudes into the inner space 82 of the quick-change tool holder.

In association with each side opening 84, 86 in the quick-change tool holder body 15, the quick-change tool holder 14 comprises a respective closing element 90, 92. The closing elements 90, 92 are configured adapted to the essentially trapezoidal inner peripheral contour of the side openings 84, 86 with a corresponding trapezoidal outer peripheral contour and thus advantageously essentially completely close them when they are inserted into a respectively associated side opening 84, 86.

In order to ensure a defined insertion depth when the closing elements 90, 92 are inserted into the side openings 84, 86 the closing elements 90, 92 can be configured with an insertion stop 94, 96 protruding, by way of example, in the direction of the central region 17, which insertion stop 94, 96 can come into contact with, by way of example, a complementary stop region 98 on the quick-change tool holder body 15 and thus limit the insertion depth for the respective closing element 94, 96, or also determine a defined position thereof with respect to the quick-change tool holder body 15.

A plate-like locking element 100 is provided on each locking element 90, 92 that can, by way of example, be secured to the respectively associated closing element 90, 92. While the closing elements 90, 92 can also, by way of example, be made of plastic or rubber or the like for cost reasons, the locking elements 100, 102 are preferentially made of metal or a very hard plastic for stability reasons.

Each locking element 100, 102 together with a peripheral region 104 or 106, arranged like part of a circle, forms a locking engagement region 108, 110 of a locking region, in general designated with 112. In the region of the holder shaft 40, which can be positioned engaging in the inner space 82 of the quick-change tool holder, a preferentially fully peripheral, annular groove-like recess 114 of a counter-locking region 116 provided on the holder shaft 40 is configured around the outer periphery of the holder shaft. When the holder shaft 40 is completely inserted into the holder opening 38, the recess 114 is positioned in such a way that when the closing elements 90, 92 are pushed into the side openings 84, 86, the locking elements 100, 102 provided on the closing elements 90, 92 engage in the recess 114 with their locking engagements regions 108, 110 and almost surround the holder shaft 114 in its entire peripheral region. As a result of this, a form-fitting engagement acting in the direction of the longitudinal axis L of the opening is generated, said form-fitting engagement preventing a detachment of the drum tool 22 from the quick-change tool holder 14.

In order to ensure that the closing elements 90, 92 remain in a defined position in the side openings 84, 86 during the compaction operation, in particular also that the locking interaction with the drum tool 22 is preserved, the closing elements 90, 92 can be locked relative to the quick-change tool holder body 15. To this end, the two closing elements 90, 92 inserted in the side openings 84, 96 can be secured to one another so that a joint lateral displacement of the closing elements 90, 92 relative to the quick-change tool holder body 15 owing to the impact of the stopping insertion stops 94, 96 on the quick-change tool holder body 15, or as the case may be also owing to the locking engagement with the holder shaft 40, is not possible.

The two closing elements 90, 92 can be secured in different ways. Snap-in means can thus be provided on the sides thereof facing one another, by means of which the two closing elements 90, 92 can be snapped into position. In an especially advantageous embodiment shown in FIG. 1 the two closing elements 90, 92 are secured relative to one another by means of screws. To this end, through-holes 118, 120 are provided in the closing element 92, through which threaded bolts 122, 124 are passed. In the closing element 90 to be positioned on the opposite side, internally threaded holes 126, 128 are provided in association with the through-holes 118, 120 into which the threaded parts of the bolts 122, 124 can be screwed. In this way, the regions ensuring the cohesion by means of the threaded interaction with one another are also completely covered during the compaction operation, so that on the one hand, soiling of these regions, and on the other hand, damages thereto can also be prevented. The internally threaded holes 126, 128 of the closing element 90 can, by way of example, be made available in that an internal thread is provided directly in the material it is made of. In particular, in the case of embodiments made of plastic or rubber, it is an advantage to integrate internally threaded elements, by way of example nuts or the like.

In order to remove the drum tool 22 from the quick-change tool holder 14, the two closing elements 90, 92 are removed from the side openings 84, 86. Since, in order to prevent damage to the closing elements 90, 92 during the compaction operation, they are preferentially inserted into the side openings 84, 86 in such a way that they completely penetrate therein, or are covered by the quick-change tool holder body 15 on the outside, the closing elements 90, 92 can be removed by first unscrewing the threaded bolts 122, 124 from the internally threaded holes 126, 128, however, without extracting said threaded bolts 122, 124 completely from the through-holes 118, 120. With the threaded bolts 122, 124 still extending inside these through-holes 118, 120, said threaded bolts 122, 124 can be pressed against one another or pressed away from one another, so that they expand in the through-holes 118, 120 and can thus be used to pull the closing element 92 out of the side opening 86. Subsequently, the other closing element 90 can be taken out through the side opening 84 by moving it through the side opening 86 and the inner space 82 of the quick-change tool holder by means of a spike-like tool. As the locking interaction of the locking region 112 with the counter-locking region 116 is also released in this way, the drum tool 22 can be pulled out of the holder opening 38 together with its holder shaft 40 and thus be removed from the quick-change tool holder body 15.

Finally, it should be pointed out that a wide range of variations of the previously described configuration are possible without deviating from the basic principle. Accordingly, the inner space 82 of the quick-change tool holder could, by way of example, only be open on one side, namely, for example, on an axial side via a side opening provided thereon, while the inner space 82 of the quick-change tool holder could be closed by a wall connecting the two leg portions 16, 18. In this case, only one closing element, by way of example, the closing element 92 would have to be inserted into the associated side opening and locked into the wall mentioned above by means of threaded bolts to be screwed therein, or as the case may be, in any other way relative to the quick-change tool holder body 15. In that case, of course, only one such closing element could be used to generate the locking interaction with the holder shaft mentioned above.

Furthermore, a drum tool could also be locked to the quick-change tool holder body 15 in that the holder shaft 40 carries a snap-in locking element which can snap into a groove-like opening provided on the inner periphery of the holder opening 38. In this case, the locking element or locking elements do not have any locking regions. The drum tool 22 can then be detached after removing the closing element or closing elements from the corresponding side openings by means of a tool, by way of example configured as a crowbar or as a spline, to be inserted into the inner space 82 of the quick-change tool holder through a side opening.

The quick-change tool holder body 15 could basically also be configured with a different shape. The leg portions 16, 18 could thus be interrupted between the two axial sides 24, 26, so that a side opening could also be formed on at least one peripheral side 28 or 30. Basically, a closing element to be provided according to the present invention could also be inserted into such a side opening oriented in the peripheral direction. As the peripheral sides 28, 30 are, however, substantially more heavily stressed than the axial sides 24, 26 during the compaction operation, the insertion of closing elements into side openings provided on the axial sides 24, 26 shown in the figures is especially advantageous.

I claim:

1. A quick-change tool holder for the attachment of a drum tool to a compaction drum of a soil compactor comprising a quick-change tool holder body having a central region wherein a holder opening for receiving a holder shaft of a drum tool is provided in the central region and two leg portions originating at the central region for firmly connecting the quick-change tool holder body to the outer periphery of the compaction drum, the central region and the leg portions surrounding an open inner space of the quick-change tool holder extending over at least one side opening, wherein a closing element, which can be inserted in association with at least one side opening, is provided, wherein two closing elements can be locked into two side openings essentially opposing one another by securing them to one another relative to the quick-change tool holder body, wherein on each closing element a locking region for a locking interaction with a counter-locking region of a drum tool to be locked onto the quick-change tool holder body is provided, wherein the locking region comprises a locking engagement region to engage in a locking recess of the counter-locking region provided on the holder shaft of a drum tool, wherein the locking engagement regions of two closing elements can be positioned as engaging in the locking recess of the counter-locking region at least sectionally surrounding the holder shaft of a drum tool.

2. The quick-change tool holder according to claim 1, wherein an inner peripheral contour of a side opening corresponds to an outer peripheral contour of a closing element.

3. A quick-change tool holder according to claim 1, wherein the quick-change tool holder body has two axial sides mutually opposing one another and essentially to be oriented in the direction of an axis of rotation of a compaction drum, and two peripheral sides mutually opposing one another and essentially to be oriented in the peripheral direction around the axis of rotation of a compaction drum, and that at least one side opening is provided in an axial side of the quick-change tool holder body.

4. A quick-change tool holder according to claim 1, wherein the closing element can be locked relative to the quick-change tool holder body.

5. A quick-change tool holder according to claim 1, wherein two essentially opposing side openings are provided, and that as closing element is provided in association with each side opening.

6. A quick-change tool holder according to claim 1, wherein at least one closing element has an insertion limiting means to limit an insertion depth of the closing element into the associated side opening.

7. The quick-change tool holder according to claim 1, wherein the locking engagement region is configured on a plate-like locking element provided on the closing element.

8. A quick-change tool holder according to claim 1, wherein at least one closing element is made of plastic or/and rubber.

9. A quick-change tool holder arrangement for the compaction drum of a soil compactor comprising a quick-change tool holder according to claim 1, and at least one drum tool that can be locked onto the quick-change tool holder.

10. A compaction drum for a soil compactor comprising at least one quick-change tool holder secured to the outer periphery of the compaction drum according to claim 1.

11. A soil compactor comprising at least one compaction drum according to claim 1.

12. The quick-change tool holder according to claim 1, wherein the closing elements can preferentially be secured to one another by means of screws.

13. The compaction drum according to claim 10, further having a drum tool that can be locked onto the quick-change tool holder.

* * * * *